US007168792B2

(12) United States Patent
Ito

(10) Patent No.: US 7,168,792 B2
(45) Date of Patent: Jan. 30, 2007

(54) INK JET PRINTER HEAD AND METHOD OF INSPECTING SAME

(75) Inventor: Atsushi Ito, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 336 days.

(21) Appl. No.: 10/944,355

(22) Filed: Sep. 16, 2004

(65) Prior Publication Data

US 2005/0062805 A1 Mar. 24, 2005

(30) Foreign Application Priority Data

Sep. 24, 2003 (JP) ..... 2003-331226

(51) Int. Cl.
*B41J 2/045* (2006.01)
*B41J 29/393* (2006.01)

(52) U.S. Cl. ..... 347/71; 347/19

(58) Field of Classification Search ..... 347/19, 347/67, 68, 69, 70, 71
See application file for complete search history.

(56) References Cited

U.S. PATENT DOCUMENTS

| | | | | |
|---|---|---|---|---|
| 5,402,159 | A | 3/1995 | Takahashi et al. | |
| 6,328,434 | B1 | 12/2001 | Soneda et al. | |
| 6,334,671 | B1 * | 1/2002 | Umehara | 347/68 |
| 6,350,020 | B1 * | 2/2002 | Yoshimura | 347/71 |
| 6,361,155 | B1 | 3/2002 | Kanda et al. | |
| 6,412,334 | B1 | 7/2002 | Kral et al. | |
| 6,523,942 | B1 * | 2/2003 | Sakamoto et al. | 347/68 |
| 6,604,817 | B1 | 8/2003 | Isono et al. | |
| 2002/0036678 | A1 | 3/2002 | Ito et al. | |

FOREIGN PATENT DOCUMENTS

| | | |
|---|---|---|
| EP | 0 357 020 A2 | 3/1990 |
| EP | 0 916 500 A | 5/1999 |
| EP | 0 943 440 A2 | 9/1999 |
| JP | 4-341853 | 11/1992 |
| JP | 09-039233 A | 2/1997 |
| JP | 2001-260349 | 9/2001 |

* cited by examiner

*Primary Examiner*—Lamson Nguyen
(74) *Attorney, Agent, or Firm*—Reed Smith LLP

(57) ABSTRACT

An ink jet printer head including a channel unit having a plurality of ink ejection nozzles arranged in a plurality of arrays and opening in a front surface of the ink jet printer head, a plurality of pressure chambers arranged in a plurality of arrays and communicating with the ink ejection nozzles, respectively, and a plurality of ink channels which deliver at least one kind of ink from at least one ink inlet to the pressure chambers, respectively, and then deliver the at least one kind of ink from the pressure chambers to the ink ejection nozzles, respectively. The channel unit includes a first sheet member having a first planar surface in which a plurality of arrays of recesses defining the plurality of arrays of pressure chambers, respectively, open. The printer head further includes a second sheet member having a second planar surface which is adhered to the first planar surface of the first sheet member so as to close the recesses opening in the first planar surface. At least one of the first sheet member and the second sheet member has at least one inspection-related groove which is located between at least one pair of arrays of recesses of the plurality of arrays of recesses, extends along the at least one pair of arrays of recesses, and communicates with an outside space.

12 Claims, 8 Drawing Sheets

PRIOR ART

PRIOR ART

INK JET PRINTER HEAD AND METHOD OF INSPECTING SAME

The present application is based on Japanese Patent Application No. 2003-331226 filed Sep. 24, 2003, the contents of which are incorporated herein by reference.

BACKGROUND OF THE INVENTION

1. Field of the Invention

The present invention relates to an ink jet printer head having a plurality of pressure chambers arranged in a plurality of arrays, and to a method of inspecting the ink jet printer head about whether the arrays of pressure chambers are fluid-tightly isolated from each other.

2. Discussion of Related Art

For example, Japanese Patent Application Publication No. 2001-260349 or its corresponding U.S. Pat. No. 6,604,817 discloses a conventional piezoelectric ink jet printer head including a channel unit constituted by a plurality of sheet members which are stacked on each other via adhesive; a piezoelectric actuator which is bonded to a back surface of the channel unit; and a flexible flat cable which is stacked on, and bonded to, a back surface of the piezoelectric actuator, for electrically connecting the actuator to an external device.

The above-indicated channel unit includes a nozzle sheet having a plurality of ink ejection nozzles opening in a front surface of the printer head; a base sheet having a plurality of pressure chambers communicating with the ink ejection nozzles, respectively; and a manifold sheet and another or other sheet members having a common ink chamber (i.e., a manifold chamber) connected to an ink supply source, and a plurality of ink channels connected to the pressure chambers, respectively. The nozzle sheet, the base sheet, the manifold sheet and the other sheet members are stacked on, and adhered to, each other. In this printer head, when an active portion of the piezoelectric actuator that corresponds to an arbitrary one of the pressure chambers of the channel unit is deformed in a direction parallel to the direction of stacking of the sheet members, a droplet of ink is ejected from the arbitrary pressure chamber via the corresponding ink ejection nozzle, so that a desired image is printed or recorded on a recording medium such as a sheet of paper.

Meanwhile, there has been proposed an ink jet printer head whose channel unit has an increased number of ink ejection nozzles arranged in a plurality of arrays, for the purpose of increasing the speed and/or density of printing (i.e., recording) of the printer head, and/or for the purpose of printing a full-color image. FIG. 6 shows an upper surface of a base sheet 117 of a channel unit of the conventional ink jet printer head. The base sheet 117 has a plurality of pressure chambers 136 which are formed through a thickness of the sheet 117 such that the pressure chambers 136 are arranged in a plurality of arrays (only three arrays are shown) corresponding to a plurality of arrays in which a plurality of ink ejection nozzles 104 are arranged. The base sheet 117 additionally has a plurality of ink supply holes 160 (160*a*, 160*b*, 160*c*, . . . ) formed through the thickness thereof. The channel unit has a plurality of common ink chambers (i.e., manifold chambers) 107 which are elongate in a lengthwise direction of the channel unit and are connected to the ink supply holes 160, respectively; a plurality of communication holes 138 arranged in a plurality of arrays; and a plurality of through-holes 137 arranged in a plurality of arrays. The arrays of pressure chambers 136 extend along the common ink chambers 107, respectively, in the lengthwise direction of the channel unit. A plurality of kinds of color inks are supplied to the common ink chambers 107, respectively, via the respective ink supply holes 160, and then each of the color inks is delivered from a corresponding one of the common ink chambers 107 to respective one end portions of the pressure chambers 136 if a corresponding one of the arrays via the respective communication holes 138. When the ink accommodated by an arbitrary one of the pressure chambers 136 is pressurized by a corresponding active portion of a piezoelectric actuator, not shown, a droplet of the ink is ejected from a corresponding one of the ink ejection nozzles 104 via the other end portion of the arbitrary pressure chamber 136 and a corresponding one of the through-holes 137.

In the above-described ink jet printer head, two closure sheet members are respectively adhered to two opposite planar surfaces of the base sheet 117 having the pressure chambers 136, so that the pressure chambers 136 are fluid-tightly closed by those closure sheet members and are thereby isolated from each other. Those two closure sheet members are a sheet member of the channel unit that is adhered to a lower planar surface of the base sheet 117, and a lowermost sheet member of the piezoelectric actuator that is adhered to an upper planar surface of the base sheet 117. However, if the adhesion of each one of the two closure sheet members to the base sheet 117 is defective, two or more pressure chambers 136 may communicate with each other. In this case, when one of those pressure chambers 136 is pressurized, ink may leak from the one pressure chamber 136 to a location outside the printer head, or to one or two adjacent pressure chambers 136 located adjacent the one pressure chamber 136. This leads to decreasing or lowering an amount and/or a pressure of the ink ejected from the desired ink ejection nozzle 104, and thereby lowering a quality of printing of the printer head. To solve this problem, a process of producing the ink jet printer head employs a step of inspecting whether the sheet members of the channel unit and/or the piezoelectric actuator have been appropriately stacked on, and adhered to, each other such that the pressure chambers 136 are fluid-tightly isolated from each other.

Next, there will be explained various routs in which ink leaks because of the defective adhesion of one or both of the two closure sheet members to the base sheet 117, by reference to the pressure chamber 136*c*, shown in FIG. 6, as a representative of all the pressure chambers 136. The ink may leak in a first route, indicated by "A", from the pressure chamber 136*c* to an outer peripheral edge of the base sheet 117 (i.e., a location outside the printer head); in a second route, indicated by "B", from the pressure chamber 136*c* to an adjacent pressure chamber 136*d* located adjacent the pressure chamber 136*c* in a same array; or in a third route, indicated by "C", from the pressure chamber 136*c* to an adjacent pressure chamber 136*e* located adjacent the pressure chamber 136*c*, in an array located adjacent the array in which the pressure chamber 136*c* is arranged. However, generally, the leakage of ink via the route "A" can be effectively prevented because a considerably large adhesion area can be provided between each pressure chamber 136 and the outer peripheral edge of the base sheet 117 and additionally one or more adhesive pouring grooves and/or one or more adhesive relieving grooves can be formed in the adhesion area. The leakage of ink via the route "B" does not adversely influence the quality of printing so much, because a pitch of arrangement of the pressure chambers 136 in a same array is very small and additionally a same kind of ink is accommodated by those pressure chambers 136. On the other hand, the leakage of ink via the route "C" may cause a problem of mixture of different kinds of color inks, because a distance between two adjacent arrays of pressure chambers 136 is considerably large and the different kinds of color inks are accommodated by the different arrays of pressure chambers 136, respectively.

Thus, the above-indicated step of inspecting the fluid-tight isolation of the pressure chambers 136 is arranged such that after the piezoelectric actuator is bonded to the upper surface of the channel unit (hereinafter, this will be referred to as the bonded body), all the ink ejection nozzles 104 are temporarily fluid-tightly closed, and a pressurized air is supplied to each one of the ink supply holes 160. If air leaks from any of the pressure chambers 136 of, e.g., the first array 161*a* that communicate with the first ink supply hole 160*a* via the corresponding common ink chamber 107, then the pressure of the pressurized air will lower. Thus, the fluid-tight isolation of the pressure chambers 136 can be inspected by measuring the pressure of the pressurized air after a prescribed time period has elapsed. If the leakage of the pressurized air is detected, i.e., the isolation of the pressure chambers 136 is found defective, then the bonded body is discarded and is not conveyed to any subsequent steps.

SUMMARY OF THE INVENTION

However, in the printer head shown in FIG. 6, the pressure chambers 136 are arranged in the plurality of arrays 161*a*, 161*b*, 161*c*, so as to correspond to the plurality of arrays in which the ink ejection nozzles 104 are arranged. If the pressurized air is simultaneously charged into, e.g., the two ink supply holes 160*a*, 160*b* corresponding to the first and second arrays 161*a*, 161*b* of pressure chambers 136, the pressurized air is supplied to those pressure chambers 136 via the corresponding common ink chambers 107. Thus, even if the adhesion of an area, W, located between the first and second arrays 161*a*, 161*b* of pressure chambers 136 may be defective and accordingly air may leak to the area W, the air will just move from one or more pressure chambers 136 of one of the two arrays 161*a*, 161*b* to one or more pressure chambers 136 of the other array. Therefore, the pressure of the pressurized air as a whole that has been charged into the pressure chambers 136 of the two arrays 161*a*, 161*b* does not lower.

Thus, a time needed to perform the inspection cannot be shortened by charging the pressurized air simultaneously into all the ink supply holes 160, or two or more adjacent ink supply holes 160, because a defect of the adhesion of the area W between each pair of adjacent arrays 161 of pressure chambers 136, that is, leakage of air through the area W cannot be found by this inspection. Therefore, it is needed to inspect each one array 161 of pressure chambers 136 by charging the pressurized air into only the corresponding ink supply hole 160, or inspect each group of arrays 161 of pressure chambers 136 (e.g., the first and third arrays 161*a*, 161*c* of pressure chambers 136) that are not located adjacent each other, by charging the pressurized air into the corresponding ink supply holes 160 (e.g., the ink supply holes 160*a*, 160*c*). However, this inspecting step is cumbersome and time-consuming.

FIG. 7 shows one ink supply hole 160*d* that communicates with two common ink chambers 107, 107 corresponding to two adjacent arrays 161*d*, 161*e* of pressure chambers 136, so that a same kind of ink is supplied from the ink supply hole 160*d* to each of the pressure chambers 136 of the two arrays 161*d*, 161*e*. In this case, it is difficult to charge a pressurized air, via the one ink supply hole 160*d*, into only one array of pressure chambers 136 out of the two arrays 161*d*, 161*e* of pressure chambers. Thus, it is difficult to inspect only one array of pressure chambers 136 out of the two arrays 161*d*, 161*e* of pressure chambers. That is, the pressurized air is simultaneously charged into the two arrays 161*d*, 161*e* of pressure chambers 136 and, even if air may leak through the area W between the two arrays 161*d*, 161*e* of pressure chambers, the pressure of the pressurized air charged into the pressure chambers 136 does not lower. Thus, the defect of the area W cannot be found from the bonded body of the channel unit and the piezoelectric actuator.

It is therefore an object of the present invention to provide an ink jet printer head, and a method of inspecting the ink jet printer head, each of which is free from at least one of the above-indicated problems. It is another object of the present invention to provide an ink jet printer head, and a method of inspecting the ink jet printer head, each of which can allow a defect of fluid-tightness between two arrays of pressure chambers to be found in a short time.

According to a first aspect of the present invention, there is provided an ink jet printer head, comprising a channel unit having a plurality of ink ejection nozzles arranged in a plurality of arrays and opening in a front surface of the ink jet printer head, a plurality of pressure chambers arranged in a plurality of arrays and communicating with the ink ejection nozzles, respectively, and a plurality of ink channels which deliver at least one kind of ink from at least one ink inlet to the pressure chambers, respectively, and then deliver the at least one kind of ink from the pressure chambers to the ink ejection nozzles, respectively. The channel unit includes a first sheet member having a first planar surface in which a plurality of arrays of recesses defining the plurality of arrays of pressure chambers, respectively, open. The printer head further comprises a second sheet member having a second planar surface which is adhered to the first planar surface of the first sheet member so as to close the recesses opening in the first planar surface. At least one of the first sheet member and the second sheet member has at least one inspection-related groove which is located between at least one pair of arrays of recesses of the plurality of arrays of recesses, extends along the at least one pair of arrays of recesses, and communicates with an outside space.

The ink jet printer head in accordance with the first aspect of the present invention may have a defect of the adhesion of the first and second sheet members and accordingly have a route in which a fluid leaks between two pressure chambers respectively belonging to the different arrays. In this case, when a fluid is charged into the ink channels and the pressure chambers via the ink inlet in a state in which the ink ejection nozzles are fluid-tightly closed, the fluid leaking from at least one of the two pressure chambers reaches the inspection-related groove located between the different arrays of pressure chambers, and eventually flows out of the inspection-related groove into the outside space. Thus, the defect of fluid-tightness of the pressure chambers unit can be easily detected.

According to a second aspect of the present invention, there is provided a method of inspecting an ink jet printer head according to the first aspect of the invention, the method comprising the steps of temporarily closing the ink ejection nozzles, charging a fluid into the ink channels and the pressure chambers via said at least one ink inlet, and inspecting whether the fluid leaks from the ink jet printer head to the outside space.

In the ink jet printer head inspecting method in accordance with the second aspect of the present invention, if the printer head has a defect of the adhesion of the first and second sheet members and accordingly has a route in which a fluid leaks between two pressure chambers respectively belonging to the different arrays, the fluid leaking from at least one of the two pressure chambers reaches the inspection-related groove located between the different arrays of pressure chambers, and eventually flows out of the inspection-related groove into the outside space. Thus, the defect of fluid-tightness of the pressure chambers can be easily detected. When a defect of a bonded body in which the channel unit and an actuator (e.g., a piezoelectric actuator) are bonded to each other is detected, the bonded body can be discarded before it is conveyed to one or more subsequent steps. Thus, the yield of the printer heads as final products can be largely improved.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described a preferred embodiment of the present invention by reference to the drawings.

Figure 1:
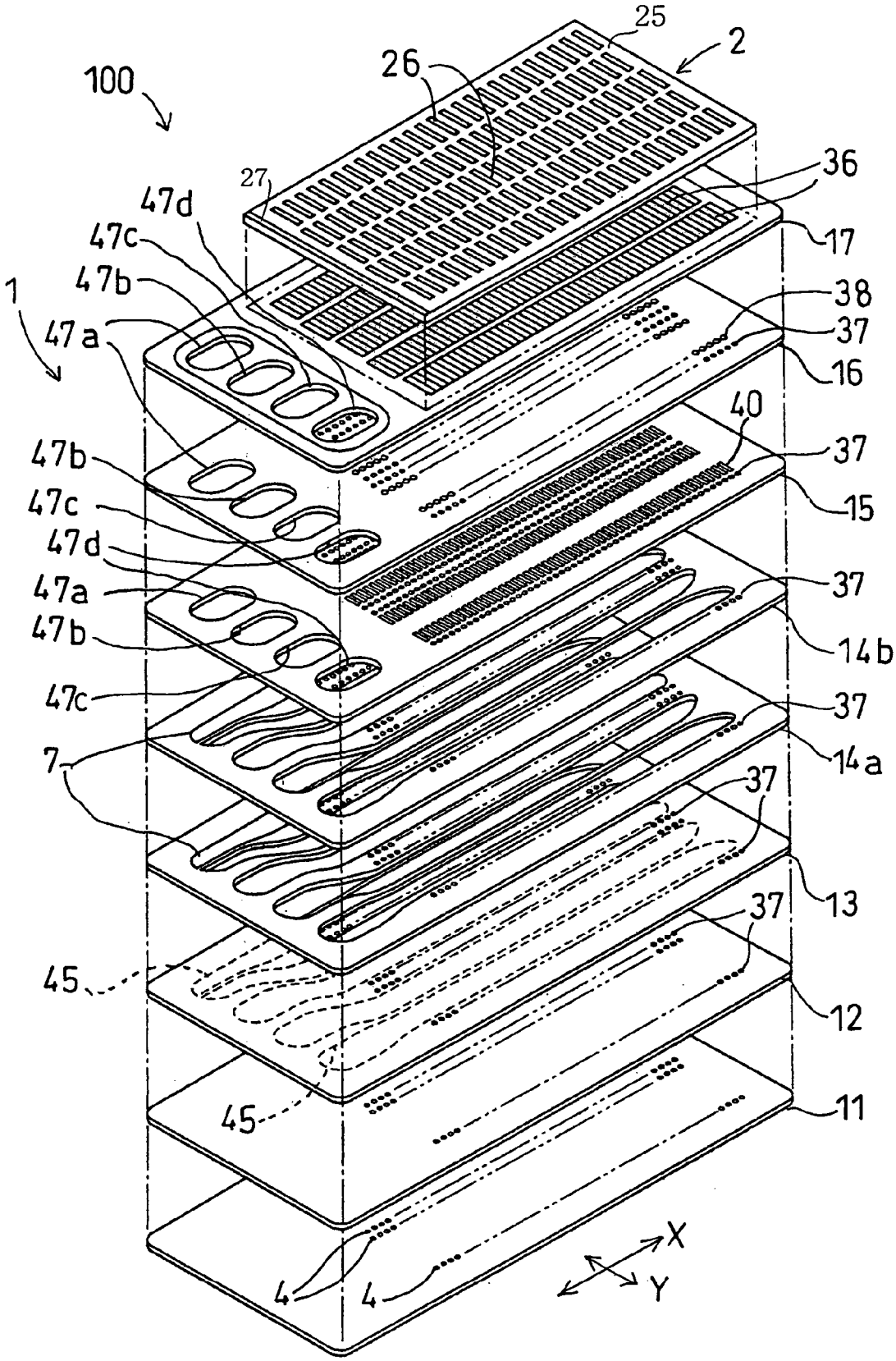
FIG. 1 is an exploded, perspective view of a portion of a piezoelectric ink jet printer head to which the present invention is applied.

As shown in FIG. 1, a piezoelectric ink jet printer head 100 as an embodiment of the present invention includes a channel unit 1 which is constituted by a plurality of sheet members; a sheet-type piezoelectric actuator 2 which is bonded to the channel unit 1; and a flexible flat cable 3 (FIG. 3A) which is stacked on, and bonded with adhesive, to an upper surface of the piezoelectric actuator 2, for the purpose of electrically connecting the actuator 2 to an external device, not shown. The channel unit 1 as the lowermost layer of the printer head 100 has a plurality of ink ejection nozzles 4 which open in a lower (i.e., a front) surface of the head 100 and each of which ejects a droplet of ink in a downward direction.

Figure 2:
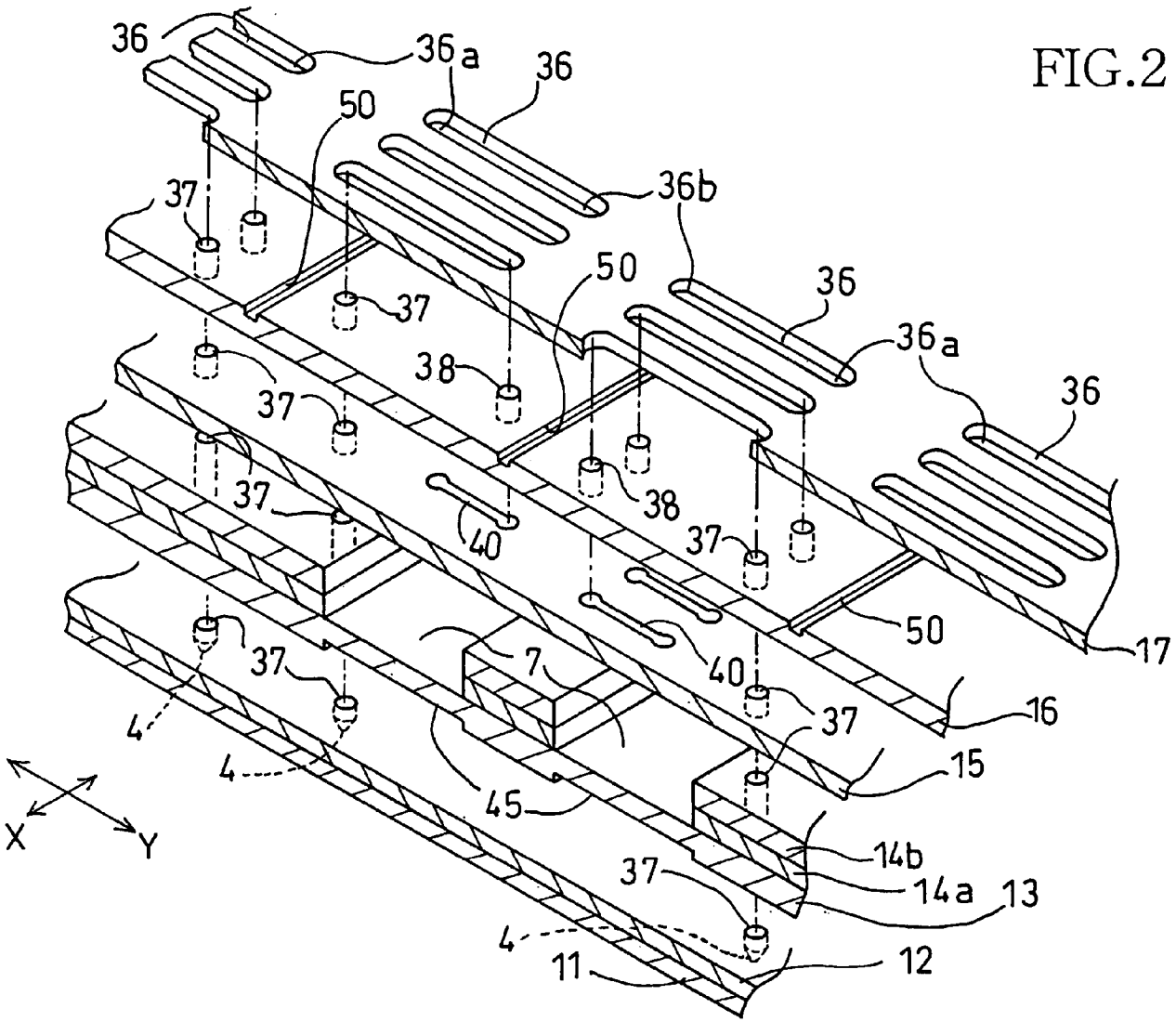
FIG. 2 is an enlarged, exploded, perspective view of a portion of a channel unit of the ink jet printer head.
Figure 3A:
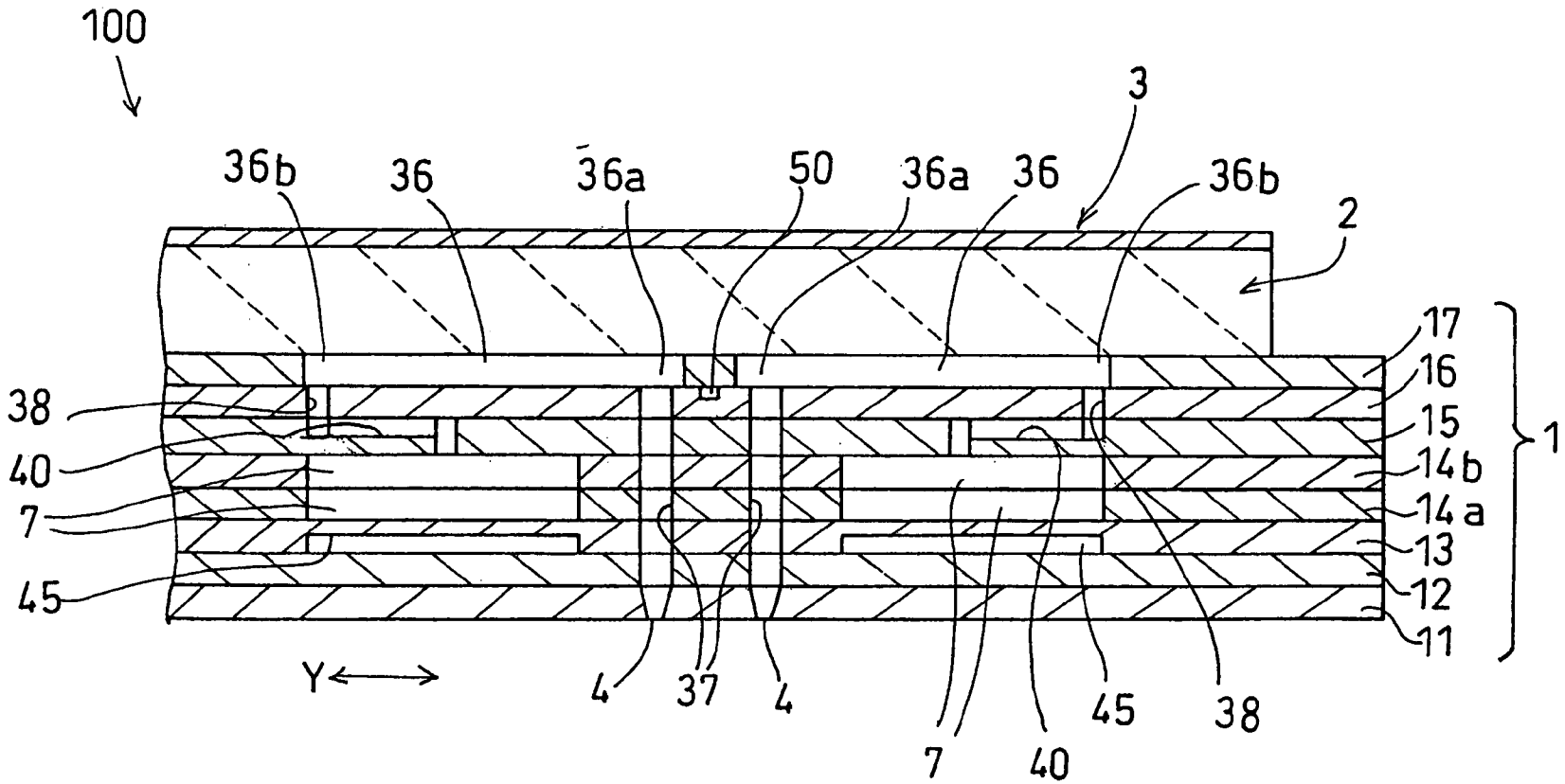
FIG. 3A is an enlarged cross-sectional view of a portion of the channel unit.

The channel unit 1 is constructed as shown in FIGS. 1, 2, and 3A. More specifically described, the channel unit 1 is constituted by eight thin sheet members which are stacked on, and bonded with adhesive to, each other. The eight sheet members include a nozzle sheet 11, a first spacer sheet 12, a damper sheet 13, two manifold sheets 14*a*, 14*b*, a second spacer sheet 15, a third spacer sheet 16, and a base sheet 17. In this embodiment, the base sheet 17 provides a first sheet member; and the third spacer sheet 16 provides a second sheet member.

In the present embodiment, each of the seven sheet members 12, 13, 14*a* 14*b* and 15 through 17, except for the nozzle sheet 11, is formed of a 42% nickel alloy steel sheet, and has a thickness of from about 50 μm to about 150 μm. The nozzle sheet 11 is formed of a synthetic resin, and has a plurality of ink ejection nozzles 4 each of which has a small diameter (e.g., 25 μm) and which are formed through a thickness of the sheet 11, at a small regular interval. More specifically described, the ink ejection nozzles 4 are arranged in five arrays in a first direction (i.e., a lengthwise direction or an X direction) of the channel unit 1 or the printer head 100.

In addition, as shown in FIG. 1, the base sheet 17 has a plurality of pressure chambers 36 which are arranged in five arrays in the lengthwise direction (i.e., the X direction) of the channel unit 1. In the present embodiment, as shown in FIG. 2, each of the pressure chambers 36 has an outlet end 36*a* communicating with a corresponding one of the ink ejection nozzles 4, and an inlet end 36*b* communicating with a corresponding one of five common ink chambers 7, described later, and is elongate in a lengthwise direction thereof passing through the outlet and inlet ends 36*a*, 36*b* thereof. A plurality of recesses defining the pressure chambers 36 are formed through a thickness of the base sheet 17, such that the lengthwise direction of each recess or each pressure chamber 36 is parallel to a widthwise direction or a Y direction of the channel unit 11 or the printer head 100, and each recess or each pressure chamber 36 has a small width in the X direction perpendicular to the Y direction.

The respective outlet ends 36*a* of the pressure chambers 36 communicates with the corresponding ink ejection nozzles 4 of the nozzle sheet 11, via respective small-diameter through-holes 37 as respective portions of a plurality of ink channels that are formed through a thickness of each of the two spacer sheets 16, 15, the two manifold sheets 14*b*, 14*a*, the damper sheet 13, and the first spacer sheet 12. More specifically described, each of the six sheet members 16, 15, 14*b*, 14*a*, 13, 12 has the small-diameter through-holes 37 arranged in five arrays in the X direction.

The third spacer sheet 16 underlying the base sheet 17 has a plurality of communication holes 38 as respective portions of the ink channels that communicate with the respective inlet ends 36*b* of the pressure chambers 36 of the base sheet 17. The communication holes 38 are formed through a thickness of the third spacer sheet 16, at respective positions aligned with the respective inlet ends 36*b* of the pressure chambers 36.

The second spacer sheet 15 underlying the third spacer sheet 16 has a plurality of connection passages 40 each of which connects between a corresponding one of the common ink chambers 7, described later, and a corresponding one of the pressure chambers 36, so that ink is supplied from the one common ink chamber 7 to the one pressure chamber 36. Each of the connection passages 40 includes an inlet portion for receiving the ink from the corresponding common ink chamber 7; an outlet portion communicating with the corresponding pressure chamber 36 via the corresponding communication hole 38; and a restrictor portion which is located between the inlet and outlet portions and has a cross-section area smaller than that of each of the inlet and outlet portions so as to exhibit the greater flow resistance than that of any other portion of the each connection passage 40.

The two manifold sheets 14*a,* 14*b* cooperate with each other to have the five common ink chambers 7 which extend in the lengthwise or X direction of the channel unit 1, along the five arrays of ink ejection nozzles 4, respectively. Each of the five common ink chambers 7 is formed through respective thickness of the two manifold sheets 14*a,* 14*b.* The two manifold sheets 14*a,* 14*b* are stacked on each other, an upper surface of the upper manifold sheet 14*b* is fluid-tightly covered with the second spacer sheet 15, and a lower surface of the lower manifold sheet 14*a* is fluid-tightly covered with the damper sheet 13. Thus, the five fluid-tight common ink chambers (i.e., five liquid-tight manifold chambers) 7 are defined. Each of the five common ink chambers 7 partly overlaps, in its plan view, the pressure chambers 36 of a corresponding one of the five arrays, and extends along the corresponding array of pressure chambers 36.

As shown in FIGS. 2 and 3A, the damper sheet 13 underlying the lower manifold sheet 14*a* has, in a lower surface thereof, five damper chambers 45 which are isolated from the corresponding common ink chambers 7. The damper chambers 45 do not extend through a thickness of the damper sheet 13, and open in only the lower surface of the same 13. The damper chambers 45 have respective shapes identical with those of the corresponding common ink chambers 7, and are aligned with the corresponding common ink chambers 7. Since the damper sheet 13 is formed of a metal sheet that is elastically deformable by an appropriate amount, respective diaphragm portions of the damper sheet 13 that define the five damper chambers 45 can vibrate between the corresponding common ink chambers 7 and the corresponding damper chambers 45. Therefore, even if, when an ink ejection operation is carried out, a pressure change produced in an arbitrary one of the pressure chambers 36 may propagate to the corresponding common ink chamber 7, the corresponding diaphragm portion of the damper sheet 13 elastically deforms and vibrates so as to absorb or attenuate the pressure change. This is a damping effect of each damper chamber 45. Thus, the pressure change can be effectively prevented from propagating to another or other pressure chambers 36 in the same array, that is, the phenomenon of so-called "cross-talk" among the pressure chambers 36 can be effectively prevented.

In addition, as shown in FIG. 1, each of the base sheet 17, the third spacer sheet 16, and the second spacer sheet 15 has, in one of lengthwise opposite end portions thereof, four ink supply holes 47 (47*a,* 47*b,* 47*c,* 47*d*) which are formed through a thickness thereof. The respective ink supply holes 47*a* of the three sheet members 17, 16, 15 are vertically aligned with each other; and likewise the respective ink supply holes 47*b,* the respective ink supply holes 47*c,* and the respective ink supply holes 47*d,* of the three sheet members 17, 16, 15 are vertically aligned with each other. Thus, four color inks supplied from four ink tanks, not shown, that are located outside the ink jet printer head 100, are delivered to respective one end portions of the five common ink chambers 7 via the four ink supply holes 47.

The ink supply holes 47 communicate with the ink ejection nozzles 4 via the respective ink channels. More specifically described, each of the four color inks is supplied from a corresponding one of the four ink supply holes 47 to a corresponding one of the five common ink chambers 7 (or corresponding two common ink chambers 7) and, then, as shown in FIG. 2, the each color ink is delivered from the corresponding one or two common ink chamber or chambers 7 to the inlet portion 36*b* of each of the pressure chambers 36 of a corresponding one of the five arrays (or corresponding two arrays) via the corresponding connection passage 40 of the second spacer sheet 15 and the corresponding communication hole 38 of the third spacer sheet 16. When the piezoelectric actuator 36 is driven or operated in a manner described later, the four color inks are delivered from the five arrays of pressure chambers 36 to the five arrays of ink ejection nozzles 4 via the five arrays of through-holes 37 of each of the six sheet members 16, 15, 14*b,* 14*a,* 13, 12.

In the present embodiment, as shown in FIG. 1, the channel unit 1 has the four ink inlet holes 47*a,* 47*b,* 47*c* 47*d,* and the five common ink chambers 7. Only the first ink inlet hole 47*a* communicates with the two common ink chambers 7 that are located in a left-hand end portion of the manifold sheets 14*a,* 14*b.* A black ink is supplied to the first ink inlet hole 47*a,* because the black ink is more frequently used than the other color inks, i.e., yellow, magenta, and cyan inks that are supplied to the other ink inlet holes 47*b,* 47*c,* 47*d,* respectively.

Figure 4:
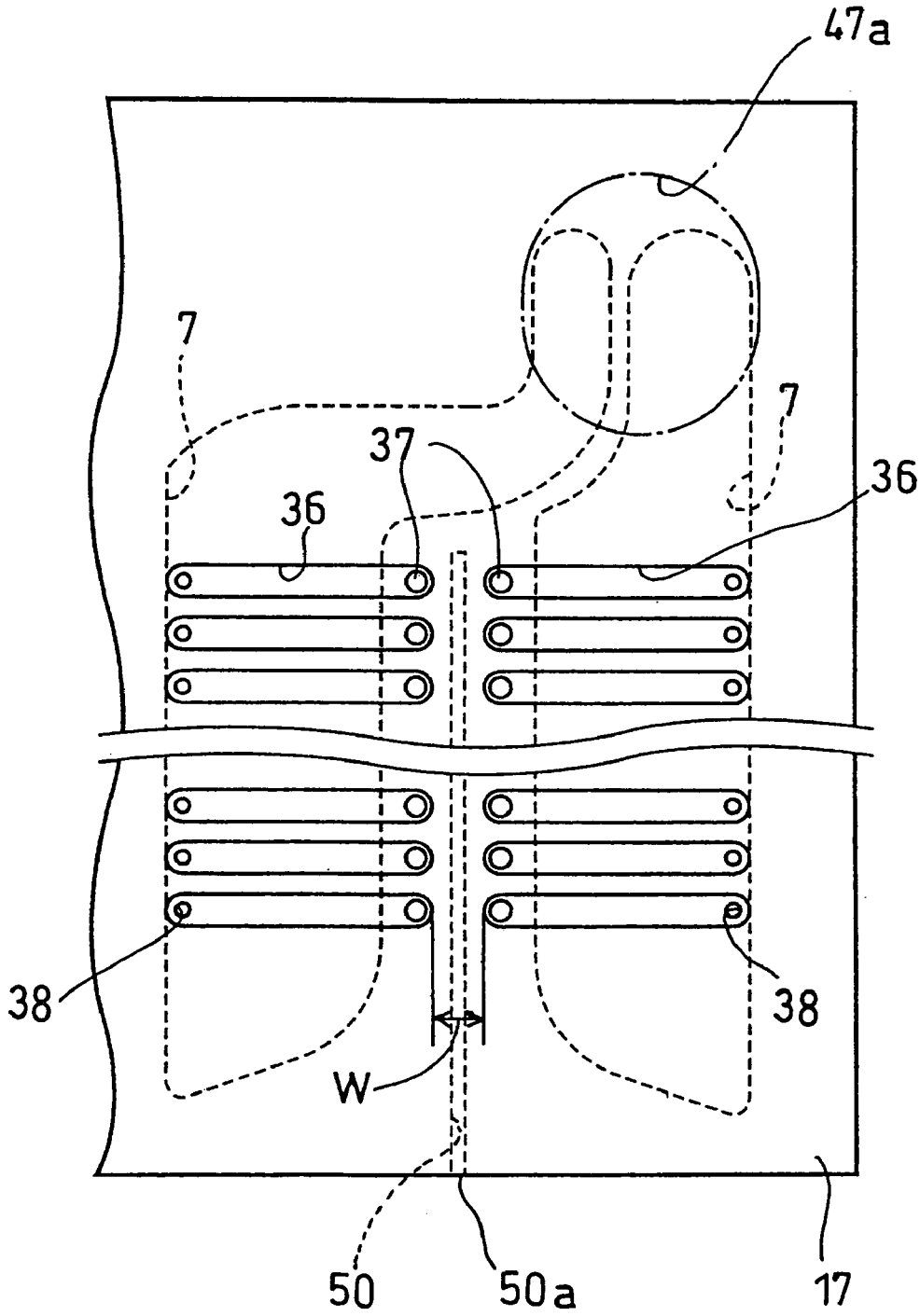
FIG. 4 is a plan view of a portion of a base sheet of the channel unit.
Figure 5:
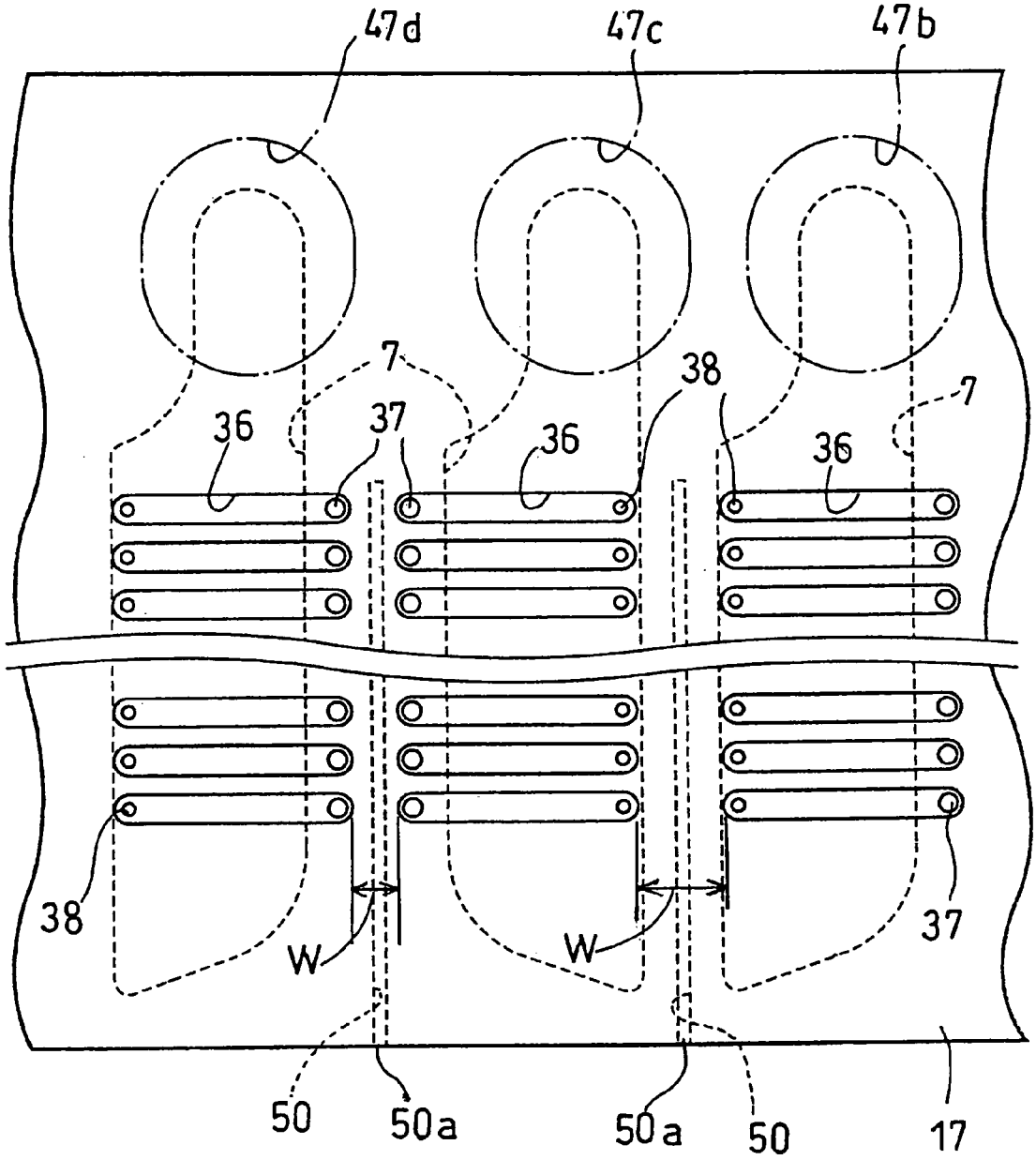
FIG. 5 is a plan view of another portion of the base sheet.
Figure 6:
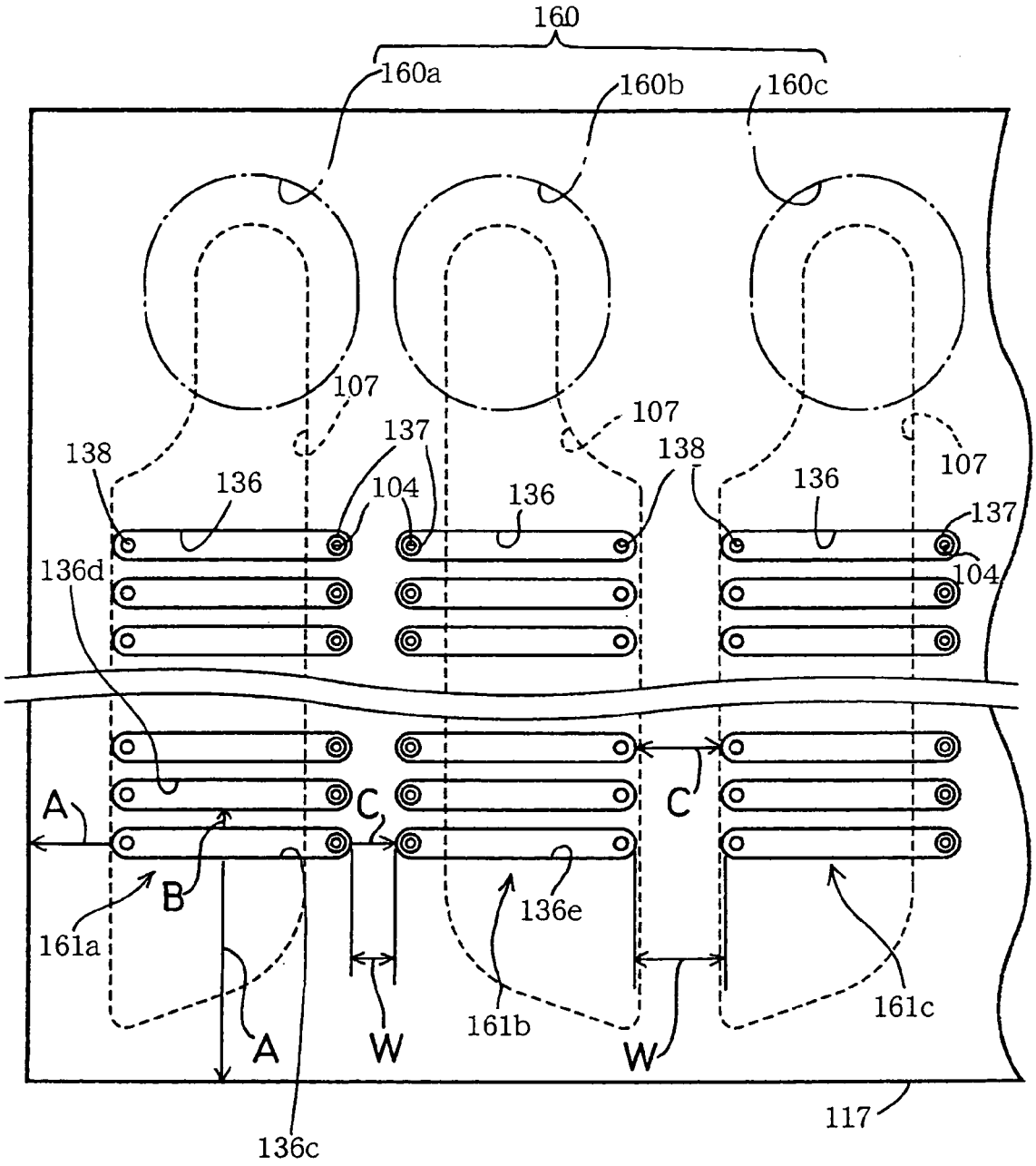
FIG. 6 is a plan view of a portion of a base sheet of a channel unit of a conventional piezoelectric ink jet printer head.
Figure 7:
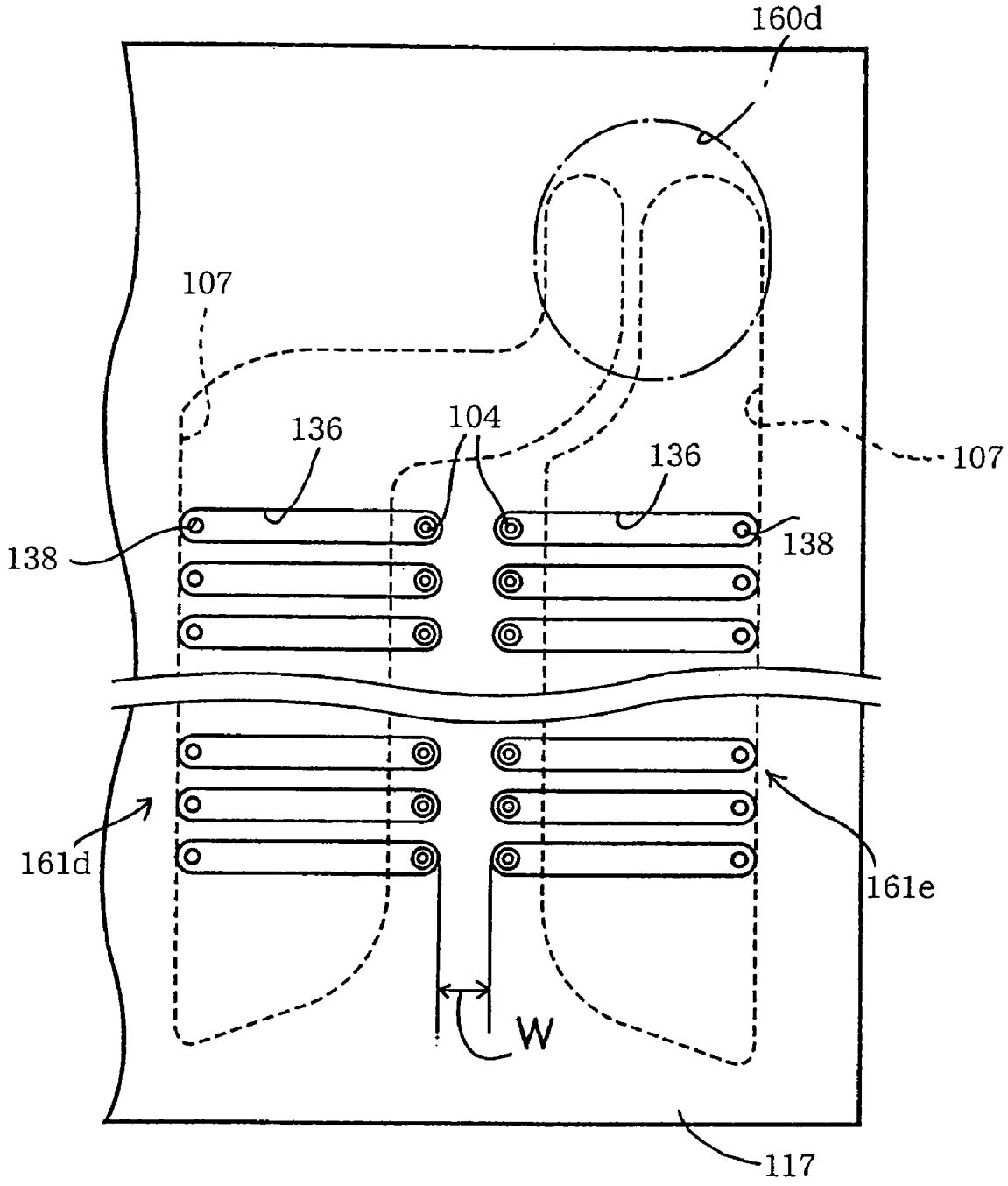
FIG. 7 is a plan view of another portion of the base sheet of FIG. 6.

At least one of the base sheet 17 and the third spacer sheet 16 has a plurality of straight inspection-related grooves 50 each of which is located between a corresponding pair of adjacent arrays of pressure chambers 36, extends along the arrays of pressure chambers 36 in the lengthwise or X direction of the channel unit 1, and communicates with an outside space. In the present embodiment, as shown in FIG. 3A, the inspection-related grooves 50 are formed in the upper planar surface of the third spacer sheet 16 that is adhered to the lower planar surface of the base sheet 17, such that the grooves 50 do not extend through the thickness of the third spacer sheet 16. Each of the four inspection-related grooves 50 in total is located between a corresponding pair of adjacent arrays of pressure chambers 36, and has an open end 50*a* that opens in one of lengthwise opposite side surfaces of the printer head 100, as shown in FIGS. 4 and 5.

The grooves, through-holes, and openings of the metallic sheet members 12, 13, 14*a,* 14*b,* 15, 16, 17, i.e., the common ink chambers 7, the through-holes 37, the communication holes 38, the connection passages 40, the damper chambers 45, the inspection-related grooves 50, etc. are formed by an appropriate kind of working, such as etching, electric discharge machining, plasma machining, or laser machining. Thus, in the embodiment shown in FIG. 3A, the inspection-related grooves 50 can be formed in the third spacer sheet 16 simultaneously when the through-holes 37 and the communication holes 38 are formed in the sheet 16; and in a modified embodiment shown in FIG. 3B, inspection-related grooves 60 can be formed in the base sheet 17 simultaneously when the recesses defining the pressure chambers 36 are formed in the sheet 17.

The piezoelectric actuator 2 includes a plurality of piezoelectric sheets, not shown, which are stacked on each other, and additionally includes a top sheet 25 (FIG. 1) which is stacked on the piezoelectric sheets. Each of the piezoelectric sheets has a thickness of about 30 μm. An internal-individual-electrode layer, i.e., five arrays of internal individual electrodes, not shown, are provided on an upper planar surface of each of the lowermost piezoelectric sheet and every second piezoelectric sheets counted from the lowermost sheet, at respective positions corresponding to the pressure chambers 36 of the channel unit 1, such that the five arrays of internal individual electrodes extend in a lengthwise direction of the piezoelectric actuator 2, i.e., in the X direction, and such that each of the internal individual electrodes has a small width and extends in the Y direction perpendicular to the X direction. In addition, an internal common electrode, not shown, which is common to all the pressure chambers 36 is provided on an upper planar surface of each of the other piezoelectric sheets of the piezoelectric actuator 2. On an upper planar surface of the top sheet 25 of the piezoelectric actuator 2, there are provided five arrays of external individual electrodes 26 that are electrically connected to the five arrays of individual electrodes of each one of the internal-individual-electrode layers, and an external common electrode 27 that is electrically connected to each one of the internal common electrodes.

However, the piezoelectric actuator 2 may be replaced with a different sort of piezoelectric actuator having such a structure in which a greater number of piezoelectric sheets are stacked on each other, as disclosed by Japanese Patent Application Publication No. 4-341853 or its corresponding U.S. Pat. No. 5,402,159.

An adhesive sheet, not shown, formed of an ink-impermeable synthetic resin as a sort of adhesive material, is adhered, in advance, to an entire lower planar surface of the sheet-type piezoelectric actuator 2 that is to be opposed to the pressure chambers 36 of the channel unit 1. Subsequently, in a state in which the internal individual electrodes of the piezoelectric actuator 2 are aligned with the pressure chambers 36 of the channel unit 1, respectively, the actuator 2 is adhered, and thereby fixed, to the upper surface of the channel unit 1. In addition, the flexible flat cable 3 is stacked on, and bonded to, the upper surface of the piezoelectric actuator 2, such that a plurality of electric wires, not shown, of the flat cable 3 are electrically connected to the individual and common external electrodes 26, 27 of the actuator 2.

When the ink jet printer head 100 constructed as described above is assembled, whether each pair of adjacent arrays of pressure chambers 36 are fluid-tightly isolated from each other is inspected in a state in which the channel unit 1 and the piezoelectric actuator 2 are bonded to each other. More specifically described, first, all the ink ejection nozzles 4 are fluid-tightly closed temporarily. Subsequently, a pressurized air as a sort of fluid is simultaneously charged into all the ink channels via the four ink inlets 47*a* through 47*d*. Then, whether some amount of air is leaking from each one of the respective open ends 50*a* of the inspection-related grooves 50 that is located between a corresponding pair of adjacent arrays of pressure chambers 36, is observed or judged by an operator or an appropriate sensor.

In the case where the adhesion of the base sheet 17 and the second spacer sheet 16 is so defective that two pressure chambers 36 belonging to a pair of adjacent arrays communicate with each other via one or more leakage routes produced in the area W located between the pair of adjacent arrays of pressure chambers 36, some amount of the pressurized air charged into the pressure chambers 36 leaks via the leakage routes into a corresponding one of the inspection-related grooves 50, and eventually flows out of the open end 50*a* of the one groove 50. Thus, the defect of the fluid tightness in the area W can be found by detecting the flowing of air out of the open end 50*a* of each inspection-related groove 50, or alternatively detecting the lowering of pressure of the air in each ink inlet 47.

In addition, in the case where the adhesion of the two sheet members 16, 17 or the adhesion of the channel unit 1 and the piezoelectric actuator 2 is so defective that some amount of the pressurized air charged into the pressure chambers 36 directly leaks into an outside space, no air may flow out of the respective open ends 50*a* of the inspection-related grooves 50, but the pressure of the pressurized air in the pressure chambers 36 may lower. In this case, if the flowing of air out of the open end 50*a* of each inspection-related groove 50, and the lowering of pressure of the pressurized air in each ink inlet 47 after a predetermined time period has elapsed are simultaneously inspected, not only the leakage of fluid (i.e., air or ink) into each area W but also the direct leakage of fluid into the outside space can be simultaneously inspected. In a modified ink jet printer head inspecting method, only the lowering of pressure of the pressurized air in each ink inlet 47 after the predetermined time period has elapsed is detected to find a defect of fluid-tightness of any of the pressure chambers 36 of the ink jet printer head 100.

If no defect of the bonded body consisting of the channel unit 1 and the piezoelectric actuator 2 is detected, then the flexible flat cable 3 is bonded to the bonded body.

The bonded body of the channel unit 1 and the piezoelectric actuator 2 has the one inspection-related groove 50 located between the two adjacent arrays of pressure chambers 36 that communicate with the two adjacent common ink chambers 7, respectively, that are commonly connected to the one ink inlet 47*a*. In the previously-indicated conventional method, the defect of the fluid tightness in the area W located between those adjacent arrays of pressure chambers 36 cannot be detected. In contrast, since the bonded body of the elements 1, 2 has the one inspection-related groove 50, the defect of the fluid tightness in the area W can be detected.

In addition, since all the ink supply inlets 47 (47*a*, 47*b*, 47*c*, 47*d*) are simultaneously charged with the pressurized air, so as to inspect the presence or absence of defect of fluid-tightness of all the pressure chambers 36, the time needed to perform the inspection can be largely shortened.

If the bonded body of the channel unit 1 and the piezoelectric actuator 2 is found to have the defect, the bonded body is discarded before the flexible flat cable 3 is bonded to the same. Therefore, the yield of the ink jet printer heads 100 as final products can be improved.

The fluid used to inspect the channel unit 1, or the bonded body of the channel unit 1 and the piezoelectric actuator 2, is not limited to air or a different kind of gas, such as an inert gas, but it may be an appropriate kind of liquid such as water.

In addition, the shape of each inspection-related groove 50 is not limited to the straight shape shown in FIGS. 4 and 5, but each groove 50 may take an arbitrary shape, such as a circular shape or a polygonal shape, depending upon a shape of one or more reference lines along which the pressure chambers 36 are arranged, so long as it communicates with an outside space of the ink jet printer head 100. Each inspection-related groove 50 may have the smallest possible cross-section area that allows a fluid to smoothly flow out of the open end 50*a* thereof.

Figure 3B:
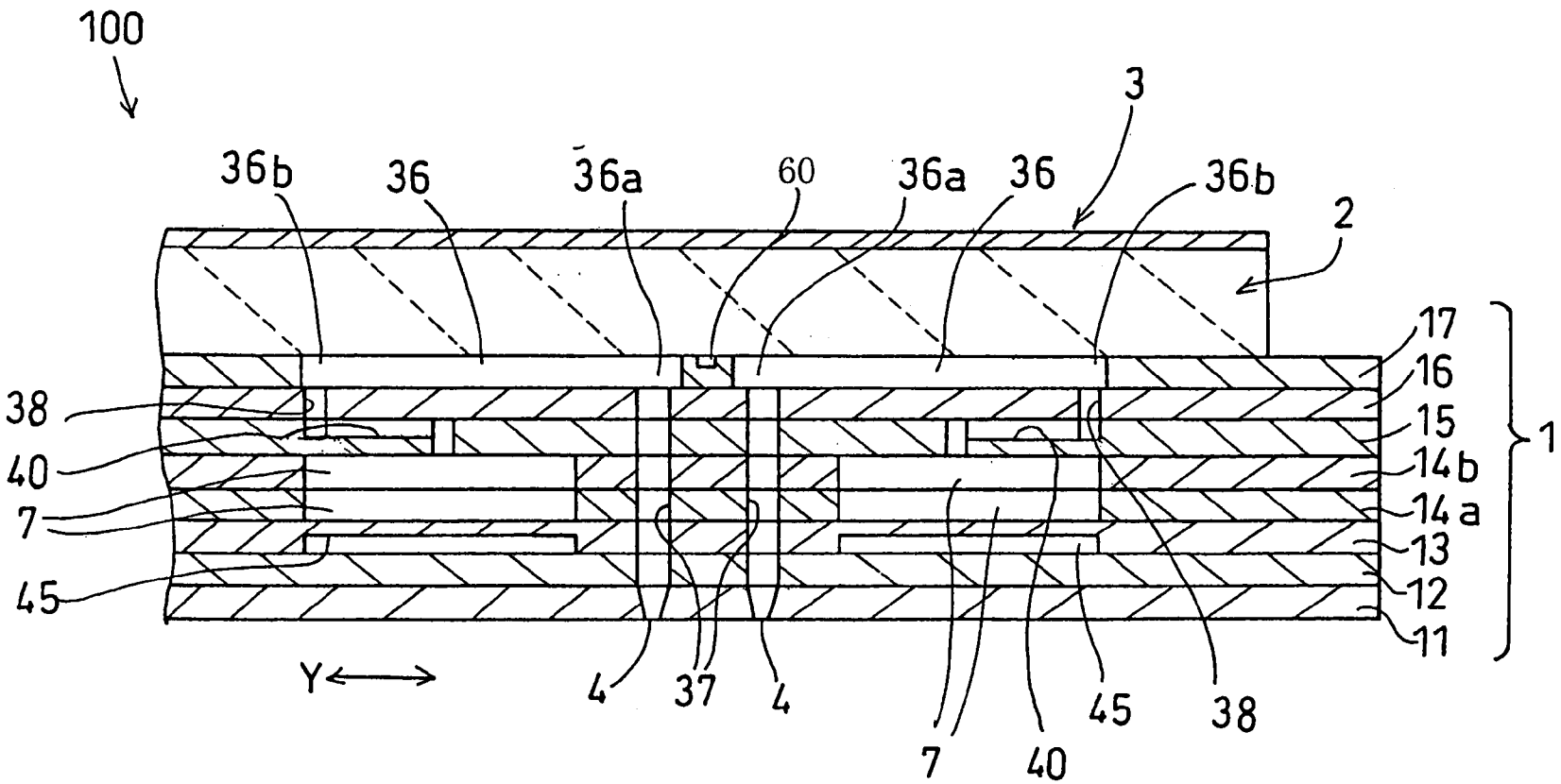
FIG. 3B is an enlarged cross-sectional view of a portion of a modified channel unit.

In the illustrated embodiment, the inspection-related grooves 50 are formed in the adhesion interface of the base sheet 17 and the third spacer sheet 16. Alternatively, as shown in FIG. 3B, the inspection-related grooves 60 may be formed in the adhesion interface of the base sheet 17 and the lower planar surface of the lowermost sheet member (e.g., the lowermost piezoelectric sheet) of the piezoelectric actuator 2, or in each of the adhesion interface of the two sheet members 16, 17 and the adhesion interface of the base sheet 17 and the actuator 2. In the illustrated embodiments, the inspection-related grooves 50, 60 are formed in the upper planar surface of the third spacer sheet 16 or the base sheet 17. However, the inspection-related grooves 50, 60 may be formed in at least one of the upper planar surface of the third spacer sheet 16, the lower planar surface of the base sheet 17, the upper planar surface of the base sheet 17, and the lower planar surface of the lowermost sheet member of the piezoelectric actuator 2.

In the illustrated embodiment, between each pair of adjacent arrays of pressure chambers 36 of the channel unit 1, there is provided one inspection-related groove 50. That is, the four grooves 50 are provided among the five arrays of pressure chambers 50. However, it is possible to provide an inspection-related groove 50 between only such a pair of adjacent arrays of pressure chambers 36 that communicate with two adjacent common ink chambers 7, respectively, that are commonly connected to one ink supply inlet 47, e.g., the ink supply inlet 47*a*.

It is to be understood that the present invention may be embodied with various changes and improvements that may occur to a person skilled in the art, without departing from the spirit and scope of the invention defined in the appended claims.

What is claimed is:

1. An ink jet printer head, comprising:

a channel unit having a plurality of ink ejection nozzles arranged in a plurality of arrays and opening in a front surface of the ink jet printer head, a plurality of pressure chambers arranged in a plurality of arrays and communicating with the ink ejection nozzles, respectively, and a plurality of ink channels which deliver at least one kind of ink from at least one ink inlet to the pressure chambers, respectively, and then deliver said at least one kind of ink from the pressure chambers to the ink ejection nozzles, respectively, the channel unit including a first sheet member having a first planar surface in which a plurality of arrays of recesses defining the plurality of arrays of pressure chambers, respectively, open; and a second sheet member having a second planar surface which is adhered to the first planar surface of the first sheet member so as to close the recesses opening in the first planar surface, wherein at least one of the first sheet member and the second sheet member has at least one inspection-related groove which is located between at least one pair of arrays of recesses of the plurality of arrays of recesses, extends along said at least one pair of arrays of recesses, and communicates with an outside space.

2. The ink jet printer head according to claim 1, wherein said at least one inspection-related groove opens in at least one of the first and second planar surfaces of the first and second sheet members, and does not extend through a thickness of said at least one of the first and second sheet members.

3. The ink jet printer head according to claim 1, wherein the ink channels comprise a plurality of common ink manifolds each of which communicates with said at least one ink inlet and delivers said at least one kind of ink to the pressure chambers of a corresponding one of the arrays that are adjacent to each other.

4. The ink jet printer head according to claim 1, further comprising an actuator which is fixed to the channel unit and which is driven to change a pressure of the ink accommodated by each of the pressure chambers of the channel unit, so as to eject a droplet of the ink from a corresponding one of the ink ejection nozzles.

5. The ink jet printer head according to claim 4, wherein the actuator includes the second sheet member.

6. A method of inspecting an ink jet printer head according to claim 1, the method comprising the steps of:

temporarily closing the ink ejection nozzles, charging a fluid into the ink channels and the pressure chambers via said at least one ink inlet, and inspecting whether the fluid leaks from the ink jet printer head to the outside space.

7. The method according to claim 6, wherein the step of inspecting comprises inspecting whether the fluid flows from said at least one inspection-related groove into the outside space, and thereby inspecting whether the fluid leaks between said at least one pair of arrays of recesses.

8. The method according to claim 6, wherein the step of charging comprises charging a pressurized fluid into the ink channels and the pressure chambers, and wherein the step of inspecting comprises inspecting whether the pressurized fluid flows from said at least one inspection-related groove into the outside space, and simultaneously inspecting whether a pressure of the charged pressurized fluid has lowered in a predetermined time period.

9. The method according to claim 6, wherein the step of charging comprises charging a pressurized fluid into the ink channels and the pressure chambers, and wherein the step of inspecting comprises inspecting whether a pressure of the charged pressurized fluid has lowered in a predetermined time period.

10. The method according to claim 6, wherein the ink channels deliver a plurality of kinds of inks from a plurality of ink inlets to the plurality of arrays of pressure chambers, respectively, and wherein the step of charging the fluid comprises simultaneously charging the fluid into the arrays of pressure chambers via the ink inlets.

11. The method according to claim 6, wherein the ink jet printer head further includes an actuator which is fixed to the channel unit and is driven to change a pressure of the ink accommodated by each of the pressure chambers of the channel unit, so as to eject a droplet of the ink from a corresponding one of the ink ejection nozzles; and a cable member which is electrically connected to the actuator and supplies an electric voltage to the actuator so as to drive the actuator, and wherein the temporarily closing step, the charging step, and the inspecting step are carried out on the channel unit to which the actuator has been fixed and the cable member has not been electrically connected.

12. The method according to claim 6, wherein the step of charging the fluid comprises charging air into the ink channels and the pressure chambers via said at least one ink inlet.

* * * * *